United States Patent [19]

Maroth

[11] Patent Number: 4,684,133

[45] Date of Patent: Aug. 4, 1987

[54] SWING FORCE INDICATOR FOR A PLAYING PIECE OF SPORTS EQUIPMENT

[76] Inventor: Sybil Maroth, 371 SW. 8th St. Apt 1B-W, Boca Raton, Fla. 33432

[21] Appl. No.: 920,748

[22] Filed: Oct. 20, 1986

[51] Int. Cl.[4] ..... A63B 69/36

[52] U.S. Cl. ..... 273/186 A

[58] Field of Search ..... 273/186-A, 26 B, 29 A, 273/186 R, 194 R

[56] References Cited

U.S. PATENT DOCUMENTS

| | | | |
|---|---|---|---|
| 2,780,098 | 2/1957 | Maroth | 273/186 A |
| 4,270,753 | 6/1981 | Maroth et al. | 273/186 A |
| 4,363,488 | 12/1982 | Maroth et al. | 273/186 A |

*Primary Examiner*—George J. Marlo

*Attorney, Agent, or Firm*—H. Gibner Lehmann; K. Gibner Lehmann

[57] ABSTRACT

A swing-force indicator for a playing piece of sports equipment intended to be swung in the playing of a game, including an elongate housing, an elongate shaft, and bearings disposed adjacent opposite ends of the housing for mounting the shaft for lengthwise turning movement therein. A manually engageable finger piece is rigid on one end of the shaft, and a weight member having an indicator is slidable along the shaft. A compression spring on the shaft engages the weight member to bias it toward one end of the shaft, to a starting position. The weight member has a pawl and the shaft has teeth cooperable with the pawl to hold the weight member in various adjusted positions remote from the starting position against the action of the compression spring. The shaft has a smooth track on which the pawl can alternately ride when the shaft is turned by the finger piece, thereby to enable return of the weight member to a starting position under the action of the compression spring. There is provided a resilient detent finger in the housing for yieldably holding the shaft in position for engagement of the teeth thereof by the pawl. The elongate shaft can be assembled to the elongate housing by a simple, purely lateral or transaxial movement involving the bearing structures at the opposite ends of the shaft.

19 Claims, 10 Drawing Figures

TURN C.C. TO RESET
YARDS
0
125
150
175
200
225
250
275
300

SWING FORCE INDICATOR FOR A PLAYING PIECE OF SPORTS EQUIPMENT

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. FIELD OF THE INVENTION

This invention relates to devices for determining the force or speed with which a playing piece associated with a sport is swung, and more particularly to indicators which respond to centrifugal force to provide the desired readings.

2. DESCRIPTION OF THE RELATED ART INCLUDING INFORMATION DISCLOSED UNDER 37 CFR §§ 1.97–1.99

More specifically the present invention involves improvements in the centrifugal or swing force indicator illustrated and described in U.S. Pat. No. 4,270,753 dated June 2, 1981, issued to A. Maroth and S. Maroth, and entitled GOLF CLUB SWING INDICATOR, and U.S. Pat. No. 4,363,488 dated Dec. 14, 1982, issued to A. Maroth and S. Maroth, and entitled SWING FORCE INDICATOR FOR PLAYING PIECE OF SPORTS EQUIPMENT.

A prior swing indicator device is shown in U.S. Pat. No. 2,780,098 dated Feb. 5, 1957, issued to A. Maroth, and entitled INDICATING GAUGE RESPONSIVE TO CIRCULAR OR ANGULAR VELOCITY. In this patented construction, a weight is slidable in response to centrifugal force along a turnable, spring-biased shaft carried by a housing mounted on a baseball bat or sports racket, and a spring biased marker member in the housing is engaged by the weight when the latter moves along the shaft, as the result of a swing. The marker member carries a pawl that is cooperable with ratchet teeth disposed on one side of the shaft. Once shifted from a starting position, the marker member remains in an extended position, corresponding to the force of the swing, until the device is reset by momentary turning of the shaft. This was accomplished by depressing a button carried at one end thereof.

U.S. Pat. Nos. 4,270,753 and 4,363,488 identified above show similar devices. The weight member and indicator member of the prior patented gauge have been combined into a single component, and turning of the shaft is accomplished by a manually engageable knob mounted at one end of the shaft. The latter is biased to a position wherein its ratchet teeth are in engagement with the pawl of the weight member. The shaft biasing is effected by a torsion spring connected between the housing and shaft, and surrounding the latter.

While the patented centrifugal force gauges functioned in a generally acceptable manner, they consisted of a relatively large number of individual components. In addition, the assembly of the torsion spring of the devices shown in the two most recent patents was cumbersome, and in some instances the spring or housing cover were susceptible of being jarred loose as a result of an impulse force experienced thereby when the club or racket struck a ball while the gauge was in use.

SUMMARY OF THE INVENTION

The above disadvantages and drawbacks of prior swing indicators are obviated by the present invention which has for one object the provision of a novel and improved swing force indicator which is extremely simple in construction and which involves relatively few separate components.

A related object of the invention is to provide an improved swing indicator as outlined above, wherein the parts can be readily assembled with a minimum of time and by relatively unskilled personnel, thereby reducing the overall manufacturing cost.

Still another object of the invention is to provide an improved swing indicator of the kind indicated, wherein the individual components are largely constituted of plastic and can be readily molded in simple mold cavities, again reducing the overall manufacturing expense.

A related object of the invention is to provide an improved swing indicator as above characterized, wherein the unit is both rugged and reliable in use over extended periods of time and under relatively harsh conditions.

A still further object of the invention is to provide an improved swing indicator as outlined above, wherein the unit is resistant to possible damage due to impulse forces resulting from use with a piece of sports equipment during striking of a ball.

The above objects are accomplished by a swing-force indicator for a playing piece of sports equipment intended to be swung in the playing of a game, comprising an elongate housing, an elongate shaft, and bearings disposed adjacent opposite ends of the housing for mounting the shaft for lengthwise turning movement therein. A manually engageable finger piece is rigid on one end of the shaft, and a centrifugal-force responsive weight member having an indicator is slidable along the shaft. A compression spring on the shaft engages the weight member to bias it toward one end of the shaft, to a starting position. The weight member has a pawl and the shaft has a row of ratchet teeth cooperable with the pawl to hold the weight member in various adjusted positions remote from the starting position against the action of the compression spring. The shaft has a smooth track on which the pawl can alternately ride when the shaft is turned by the finger piece, thereby to enable return of the weight member to a starting position under the action of the compression spring. There is provided a resilient detent finger in the housing, disposed substantially transverse to the axis of the shaft. The shaft and detent finger have cooperable means for yieldably holding the shaft in position for engagement of the teeth thereof by the pawl.

Other features and advantages will hereinafter appear.

DESCRIPTION OF THE PREFERRED EMBODIMENT

Figure 1:
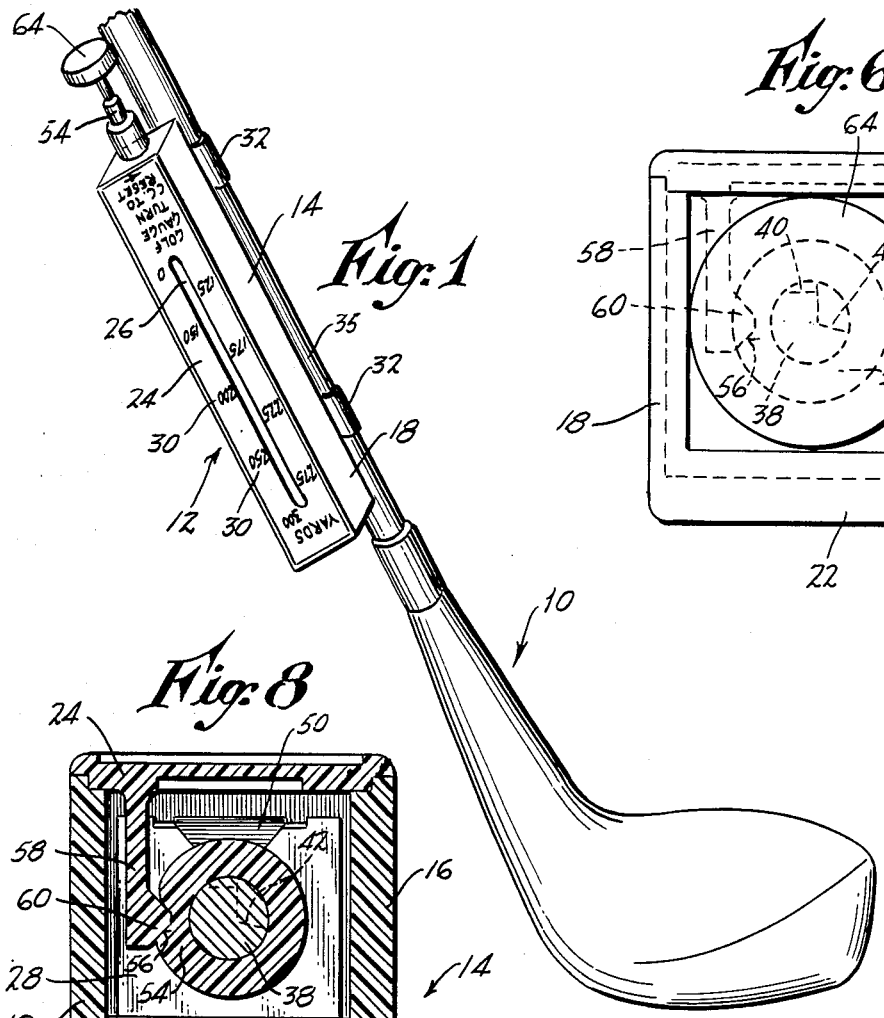
FIG. 1 is a perspective view of a golf club showing the improved swing indicator of the present invention, including a housing having a cover piece, the housing being secured in operative position on the club shaft.
Figure 6:
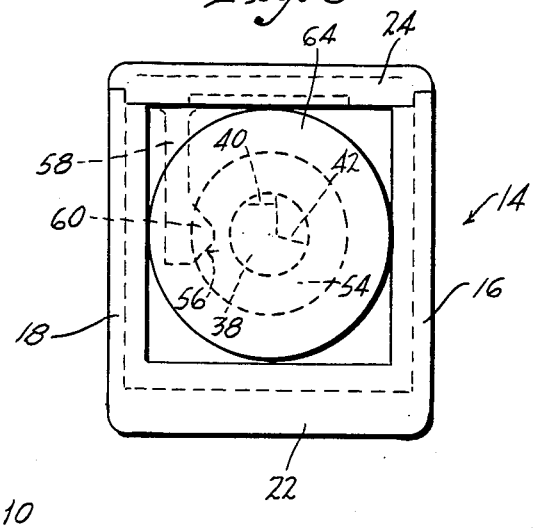
FIG. 6 is a right end elevation of the swing indicator of FIGS. 1–5.

Referring first to FIG. 1 there is illustrated a golf club generally designated by the numeral 10, having the improved centrifugal-force operated indicator or swing force gauge 12 of the present invention secured thereto in operative position.

The gauge is particularly illustrated in FIGS. 2–9 and comprises an elongate housing 14 preferably constituted of molded plastic, having oppositely disposed side walls 16, 18, an end wall 20, a bottom wall 22 and a cover plate 24. The cover plate 24 has a longitudinal slot 26 constituting a window, to permit viewing the position of a moveable weight 28 disposed in the housing, as will be described below. On opposite sides of the slot are calibrating indicia 30, shown as numerals indicating yards; other markings could be included, such as units of force, or of speed, as can be readily understood. The upper edges of the housing walls 16, 18 and 20 are stepped, FIGS. 6, 8, and 9, and the cover plate has a cooperable step formation that overlies these edges and is centralized thereby.

Figures 2, 3, 4, 5:
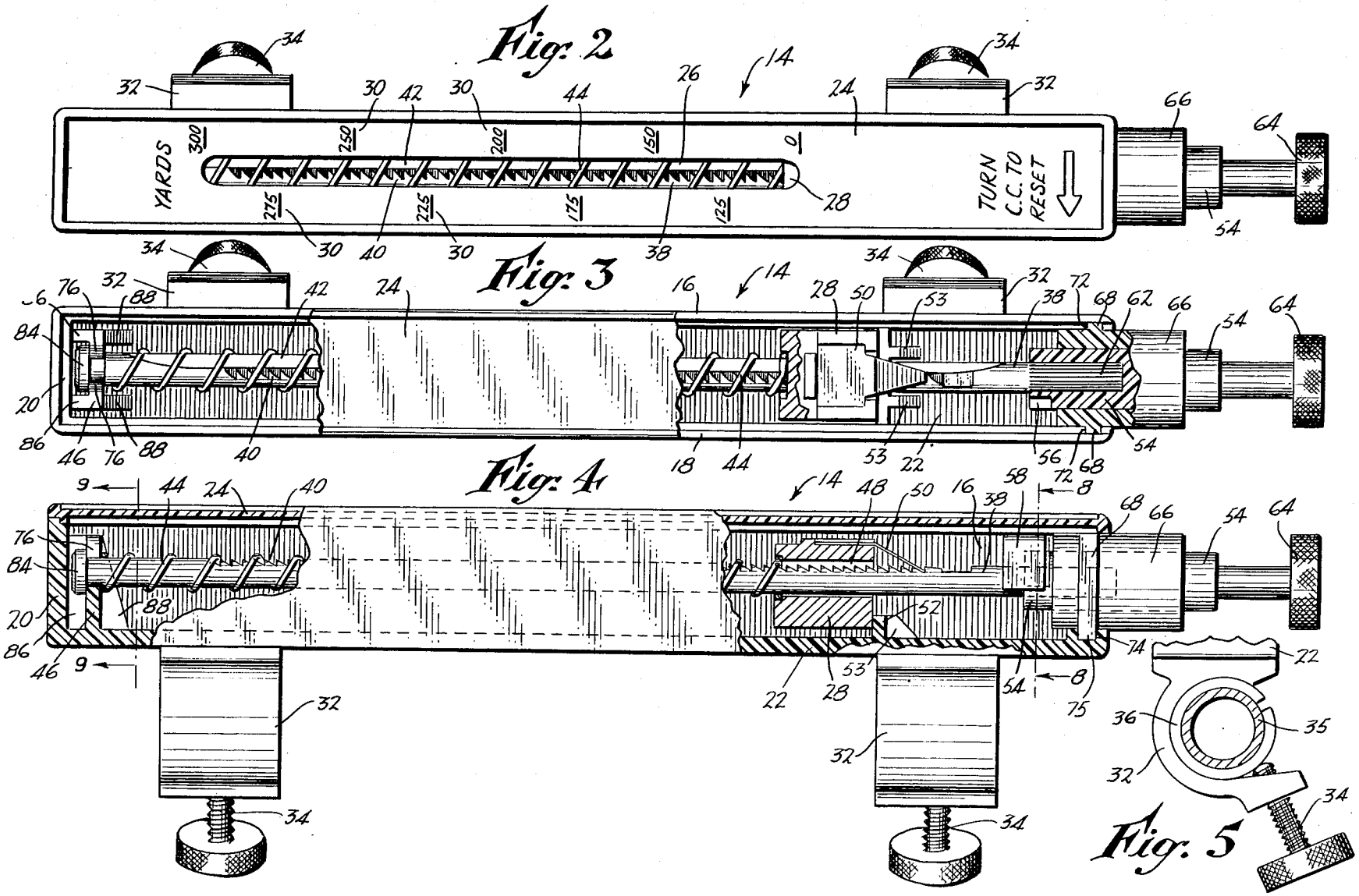
FIG. 2 is a top plan view of the improved swing indicator of FIG. 1.
FIG. 3 is a view, partly in top plan and partly in axial section, of the swing indicator of FIGS. 1 and 2.
FIG. 4 is a view, partly in side elevation and partly in axial section, of the swing indicator of FIGS. 1–3.
FIG. 5 is a fragmentary end view looking from the right end in FIG. 4, illustrating one of the clamp devices secured to a golf club shaft with an intermediate split bushing.

The housing has a pair of C-clamps 32 carrying clamping screws 34, by which the housing can be secured to the shaft 35 of the golf club 10. Interposed between the screws 34 and the golf club shaft 35 are slotted bushings 36, FIG. 5, which protect the exterior surface of the club shaft from scratches or marring. The C-clamps are illustrated in FIGS. 4 and 5.

Supported in the housing 14 for limited turning is part of a device that performs the function of a pawl and ratchet, such part in the illustrated embodiment of the invention comprising an elongate shaft 38 having a one-way track in the form of a series of ratchet teeth 40 extending along one side, and a relieved portion in the form of a smooth track 42 which is coextensive therewith and displaced circumferentially by 90 degrees or so. Surrounding the shaft 38 is a compression spring 44, one end of which seats against a saddle 46 in the housing 14, and the other end of which bears against the weight member 28. The member 28 is in the form of a block having a central opening 48 through which the shaft 38 extends, and which has opposite sides dimensioned to have a free sliding fit with the inner surfaces of the side walls 16, 18 of the housing. One end of the member 28 defines a transverse line, FIG. 2, which can be seen through the window 26, and which registers with calibration lines on the cover plate 24, following use of the gauge.

Rigidly attached to the member 28 is a pawl device in the form of a resilient leaf spring 50 that is cooperable with the ratchet teeth 40 of the shaft. FIGS. 3 and 4 illustrate the member 28 in a starting position wherein it is in engagement with a stop lug 52 integral with the bottom wall 22 of the housing. The stop lug 52 has stiffening ribs 53, FIG. 8, integral therewith and with the bottom wall 22.

The present illustrated centrifugal movement comprising the weight 28 and rack shaft 38 is characterized by teeth 40 on the shaft 38. However, other types of centrifugal devices are possible, having a pawl and rack function, as for example a smoothsurfaced shaft which constitutes a one-way track, and a backcheck leaf spring or rigid, biased rider engaging the one-way track or smooth shaft surface, all as in the manner of lifting jacks for automobiles and the like. In this application I consider any device having a pawl and rack function as including a shaft having either smooth gripping surfaces or notched or toothed surfaces.

Figure 10:
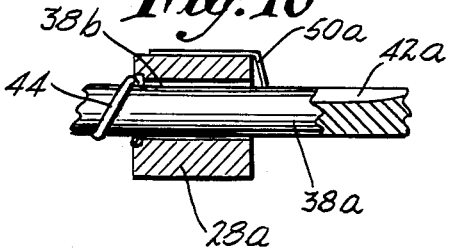
FIG. 10 is a detail of a modified form of pawl and rack device wherein a shaft has a smooth gripping surface.

For example, FIG. 10 illustrates a pawl and rack device having a shaft 38*a* provided with a smooth gripping surface 38*b* which is cooperable with a light, backcheck leaf spring 50*a* carried by a centrifugally responsive weight member 28*a*. The shaft 38*a* has a relieved portion 42*a* which constitutes a clearance return track for the leaf spring when the shaft 38*a* is turned approximately 90° during the re-set operation.

According to the invention, a unique cost-saving shaft bearing and mounting means is provided, described in detail further below, which turnably mounts the shaft 38 in the housing 14 in the position indicated in the figures. In connection with such disposition of the shaft 38, and referring now particularly to FIGS. 6–8 there is provided in accordance with the present invention a simplified cooperable detent structure acting between the shaft 38 and housing 14, which functions to yieldably retain the shaft 38 in a rotative position wherein the ratchet teeth 40 are engaged by the pawl 50, as in FIGS. 3 and 4. In effecting this, the shaft 38 rigidly carries a collar 54 having a detent notch 56 in its outer surface, and integral with the cover plate 24 is a resilient spring finger 58 having a side projection 60 which is received in the detent notch 56 to yieldably resist turning of the shaft 38. The end of the shaft 38 preferably is ribbed, as at 62, or has knurling, and the collar 54 is pressed onto the shaft 38 so as to be rigid therewith. A manually-engageable reset knob 64 is carried by the collar 54, as shown.

According to the invention the shaft 38 can be assembled to the housing 14 by a simple, purely lateral or trans-axial movement involving the bearing structures at the shaft ends. Accordingly, as shown, the collar 54 is turnably carried in a tubular bearing block 66 that is separate from the housing 14, and has oppositely disposed parallel side ribs 68 (FIG. 3) which are respectively received in side slots 72, in the inner surfaces of the opposite side walls 16, 18 respectively at the one end portion of the housing 14. The ribs 68 and slots 72 are particularly illustrated in FIGS. 3 and 4. A transverse bottom slot 74 is provided in the bottom wall 22 at the end portion of the housing, and receives a rib 75 of the bearing block 66. The block 66 is engaged by the cover plate 24 of the housing 14 when the plate is assembled. The cover plate 24 thus holds captive the bearing block 66, and is preferably sonic welded in position, as in FIG. 4.

Figure 9:
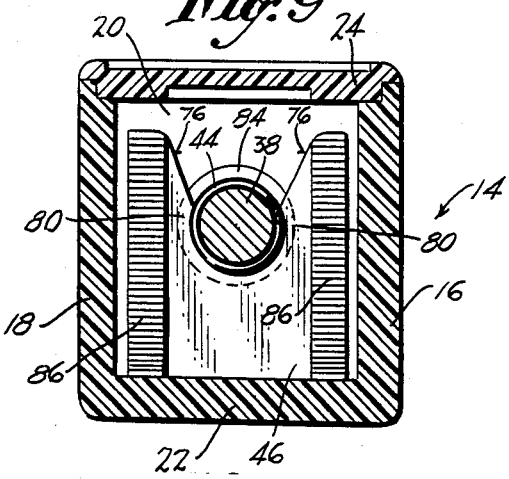
FIG. 9 is a transverse section taken on the line 9—9 of FIG. 4.

The novel shaft assembly to the housing further involves the opposite end of the shaft 38, which is received and held captive in the bearing comprising the saddle or yoke 46, FIGS. 3, 4 and 9. The yoke 46 is open at the top, having divergent walls 76 that guide the shaft 38 during assembly and enable it to be merely snapped into place laterally of the housing 14, simultaneously with the insertion of the bearing block 66 into the housing 14. The yoke 46 also has re-entrant wall portions 80 on its legs, that retain the shaft 38.

Disposed at the end of the shaft is a head 84 which restrains opposite movements of the shaft in an axial direction. The head 84 is sandwiched between the end wall 20 of the housing 14, and the yoke 46. Disposed between the yoke 46 and end wall 20 are strengthening ribs 86 which together with the end wall 20, form a box-like enclosure in which the head 84 is received. Additional strengthening ribs 88 are provided between the yoke 46 and the bottom wall 22 of the housing 14. The provision of the ribs 86 and 88 is considered to be an important feature of the invention, since the mechanism is intended to be used with sports equipment such as golf clubs or various types of rackets while they are in use and being subjected to impulse forces resulting from striking a ball or other object. The ribs minimize the possibility of failure or breakage of the yoke 46, which would, of course, render the device inoperative.

Figure 8:
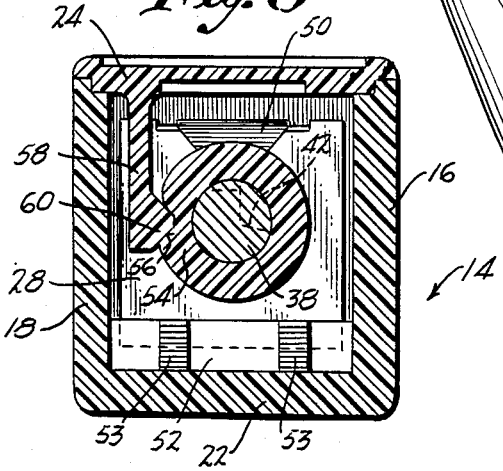
FIG. 8 is a transverse section taken on the line 8—8 of FIG. 4.
Figure 7:
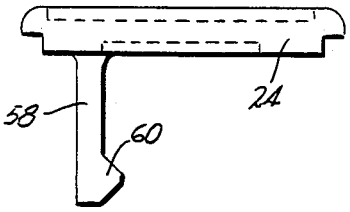
FIG. 7 is a right end elevation of the cover piece of the housing of the swing indicator of FIGS. 1–6, particularly illustrating the integral detent finger carried thereon.

In use, the gauge is reset to its starting position with the weight member 28 being located as shown in FIGS. 2–4 by turning the knob 64 in a counterclockwise direction by one-quarter turn from the position shown in FIG. 8, which will cause momentary disengagement of the pawl 50 and ratchet teeth 40, and enable the spring 44 to freely slide the weight member toward the right until it strikes the lug 52. During this time the pawl rides on the relieved portion or smooth track 42 of the shaft 38. As the shaft is turned, the detent finger 58 yields toward the left, leaving the notch 56 in the collar and riding up onto the cylindrical part thereof. The user encounters slight resistance during the initial turning movement.

The shaft is then rotated one-quarter turn in the opposite direction, and the notch 56 of the collar arrives at the location of the end of the finger once again; at this time the user can feel the detent finger slide into the notch of the collar, indicating to him that the gauge is re-set.

Upon the user swinging the club or racket, the weight member 28 moves against the action of the spring 44, by-passing a particular number of ratchet teeth according to the force or speed of the swing. An indication of the force can then be determined from the a reading of the position of the member 28, as viewed through the slot or window 26.

As noted above the gauge has the following advantages. It is constituted of relatively few separate parts, mostly molded plastic components and simple metal parts. The fabrication is greatly simplified as compared to prior units, since an assemblage consisting of the shaft 38, spring 44, weight member 28, collar 54, bearing block 66, and knob 64, can be inserted through the elongate open top of the housing 14 with purely lateral or trans-axial movement. The left end of the shaft is 38 snapped into the yoke 46 at the same time that the ribs 68 of the bearing block 66 are inserted into the slots 72 in the housing. This construction is in sharp contrast to some of the prior structures where the end of the shaft had to be inserted into a bearing aperture in the end wall of the housing, after which the other end of the shaft was positioned in its bearing at the opposite end of the housing.

As presently understood, the simplified component structure coupled with reduced assembly time reduces the overall manufacturing expense considerably. Moreover, the assembly can be carried out by unskilled personnel, and with little or no special equipment being required.

The disclosed device is thus seen to constitute a distinct advance and improvement in the field of force or speed gauges or indicators for sports equipment of the type intended to be swung or otherwise manipulated.

While the disclosed embodiment relates to an attachment for a golf club, it can be readily understood that the present invention can also be applied to other playing pieces of sports equipment that are intended to be swung in the playing of a game, such as tennis or racketball rackets, baseball bats, etc. The calibrating indicia indicated in FIG. 2 could alternately indicate "feet", or "meters", for use in baseball, or the gauge could be calibrated in other units to reflect speed. In the case of a racket sport, units of either speed or force would be appropriate.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A swing-force indicator for a playing piece of sports equipment intended to be swung in the playing of a game, comprising, in combination:

(a) an elongate housing, (b) an elongate shaft, and bearings disposed adjacent opposite ends of said housing for mounting the shaft for lengthwise turning movement in the housing, (c) a manually engageable finger piece rigid on one end of the shaft, (d) a weight member having an indicator, slidable along the shaft, (e) a compression spring on the shaft, engaging the weight member to bias it toward one end of the shaft, to a starting position, (f) said weight member having a pawl device and said shaft having a one-way track which the pawl device can traverse and with which it is cooperable to hold the weight member in various adjusted positions remote from the starting position as attained in response to centrifugal force acting against the action of the compression spring, (g) said shaft having a relieved track portion over which the pawl device can alternately freely ride when the shaft is turned by the finger piece, thereby to enable return of the weight member to a starting position under the action of the compression spring, and (h) a resilient detent finger in said housing, (i) said shaft and detent finger having cooperable means for yieldably holding the shaft in a position for engagement of the track thereof by the pawl device of the weight member.

2. The invention as set forth in claim 1, wherein:

(a) said cooperable means comprises a collar rigidly carried on the shaft,
(b) said collar having a detent notch, and said finger having a portion engaging the walls of said detent notch.

3. The invention as set forth in claim 2, wherein:
(a) said finger is elongate, and has a side projection,
(b) said side projection engaging the walls of the detent notch.

4. The invention as set forth in claim 1, wherein:
(a) said detent finger is elongate,
(b) said housing comprising a cover plate,
(c) said detent finger being carried by said cover plate.

5. The invention as set forth in claim 4, wherein:
(a) said detent finger is integral with said cover plate.

6. The invention as set forth in claim 4, wherein:
(a) said cover plate is sonic welded to the remainder of the housing.

7. The invention as set forth in claim 2, wherein:
(a) said shaft is ribbed at one end,
(b) said collar having a bore press fitted onto the ribbed portion of the shaft.

8. A swing-force indicator for a playing piece of sports equipment intended to be swung in the playing of a game, comprising, in combination:
(a) an elongate housing having an elongate open side,
(b) a shaft having a one-way track and having a relieved portion coextensive with said one-way track,
(c) a weight member slidable on the shaft, having a pawl engageable with the one-way track of the shaft,
(d) a spring on said shaft, biasing the weight member toward one end of the shaft against the action of the one-way track,
(e) a finger piece on one end of said shaft to turn the shaft for traversal of the pawl over said relieved portion, and
(f) cooperable bearing means on the ends of the housing and shaft, enabling the shaft to be inserted in the housing through the elongate open side thereof with solely transaxial movement with respect to the housing, said means rotatably supporting the shaft in the housing for movement of the weight member along the shaft.

9. The invention as set forth in claim 8, wherein:
(a) said cooperable bearing means comprises a bearing block carrying one end of the shaft,
(b) said housing having oppositely disposed shoulders on its inner surface,
(c) said bearing block engaging and being supported by said shoulders when the shaft is assembled in the housing.

10. The invention as set forth in claim 8, wherein:
(a) said cooperable bearing means comprises a bearing block carrying one end of the shaft,
(b) said housing having oppositely disposed transverse slots in its inner surface,
(c) said bearing block having opposite rib portions received in said slots when the shaft is assembled in the housing.

11. The invention as set forth in claim 9, wherein:
(a) said housing has a cover plate,
(b) said cover plate engaging the bearing block to thereby hold it captive.

12. The invention as set forth in claim 10, wherein:
(a) the slots are substantially parallel to one another and normal to the housing axis,
(b) said opposite rib portions of the block being substantially parallel to one another to enable the block to slide into the slots in the housing from the side thereof.

13. The invention as set forth in claim 8, wherein:
(a) said cooperable bearing means comprises a saddle carried by the housing, said saddle comprising a yoke having a divergent mouth and re-entrant side walls, to enable the shaft to be inserted into the yoke from the side thereof and held captive therein.

14. The invention as set forth in claim 13, and further including:
(a) a head on the shaft, engageable with an end wall of the housing and the yoke, to restrain the shaft against axial movement in the housing.

15. The invention as set forth in claim 13, wherein:
(a) said yoke has a side surface constituting a seat for one end of the spring.

16. The invention as set forth in claim 13, and further including:
(a) strengthening ribs extending between the yoke and the end wall of the housing.

17. The invention as set forth in claim 13, and further including:
(a) strengthening ribs extending between the yoke and the bottom wall of the housing.

18. The invention as set forth in claim 14, and further including:
(a) strengthening ribs extending between the yoke and the end wall of the housing,
(b) said yoke, ribs, and end wall defining a box-like structure in which the head on the shaft is confined.

19. The invention as set forth in claim 1, wherein:
(a) said one-way track comprises a smooth surface of the shaft,
(b) said pawl device comprising a light back-check leaf spring normally biased into a binding relationship with respect to the smooth surface of the shaft.

* * * * *